US007128670B2

(12) United States Patent
Souders et al.

(10) Patent No.: US 7,128,670 B2
(45) Date of Patent: Oct. 31, 2006

(54) BALL BATS AND METHODS OF MAKING SAME

(75) Inventors: Roger Souders, San Marcos, CA (US); Randy Willis, Vista, CA (US)

(73) Assignee: Honor Life, Inc., Vista, CA (US)

( * ) Notice: Subject to any disclaimer, the term of this patent is extended or adjusted under 35 U.S.C. 154(b) by 0 days.

(21) Appl. No.: 11/039,350

(22) Filed: Jan. 21, 2005

(65) Prior Publication Data

US 2005/0143203 A1 Jun. 30, 2005

Related U.S. Application Data

(63) Continuation-in-part of application No. 10/720,693, filed on Nov. 25, 2003, now abandoned.

(51) Int. Cl.
*A63B 59/06* (2006.01)

(52) U.S. Cl. ..... 473/567

(58) Field of Classification Search ..... 473/564–568, 473/519, 520, 457
See application file for complete search history.

(56) References Cited

U.S. PATENT DOCUMENTS

| | | | |
|---|---|---|---|
| 3,921,978 | A | 11/1975 | Warren |
| 4,898,386 | A | 2/1990 | Anderson |
| 4,951,948 | A | 8/1990 | Peng |
| 5,133,551 | A | 7/1992 | Handy et al. |
| 5,219,164 | A | 6/1993 | Peng |
| 5,303,917 | A | 4/1994 | Uke |
| 5,593,158 | A | 1/1997 | Filice et al. |
| 6,254,502 | B1 | 7/2001 | Becker |
| 6,406,387 | B1 | 6/2002 | Ryan |
| 2005/0221924 | A1 | 10/2005 | Sutherland et al. |

OTHER PUBLICATIONS

Fleisig et al, "Correlations Between Bat Speed and Mass Properties", Presented at NACOB 98: North American Congress on Biomechanics, Canadian Society for Biomechanics—American Society of Biomechanics, University of Waterloo, Waterloo, Ontario, Canada, Aug. 14-18, 1998, four pages.

Walters, "UF must adjust to new bat regulations in 2000", The Independent Florida Alligator on Line, Thursday, Oct. 21, 1999, three pages.

OSHMAN—The Best Online Selection of sporting Goods web site, Baseball/Softball Buyers Guides, "How to Buy A Baseball Bat", five pages.

National Collegiate Athletic Association (NCAA), 2003 Baseball Rules and Interpretations, seven pages.

*Primary Examiner*—Mark S. Graham
(74) *Attorney, Agent, or Firm*—Nixon & Vanderhye, PC

(57) ABSTRACT

Ball bats and methods of making the same are disclosed whereby the handle and barrel members are separate structural components, and whereby the handle member is of sufficient length to extend through the hollow barrel member. The handle member is connected to the barrel member at its proximal and distal ends by proximal and distal connectors. The connection between the handle member at the proximal end of the barrel member is by means of an elastomeric proximal connector. The connection between the handle member and the distal end of the barrel member is accomplished by means of a rigid distal connector. The rigid connection of the handle member's distal end to the distal end of the barrel member and the elastomeric (flexible) connection between the handle member and the proximal end of the barrel thereby allows the handle member to flex substantially across its entire length during ball impact.

19 Claims, 9 Drawing Sheets

BALL BATS AND METHODS OF MAKING SAME

CROSS-REFERENCE TO RELATED APPLICATION

The present is a continuation-in-part (CIP) of U.S. Pat. application Ser. No. 10/720,693 now abandoned filed on Nov. 25, 2003, entitled "Ball Bats and Methods of Making the Same", the entire content of which is expressly incorporated hereinto by reference.

FIELD OF THE INVENTION

The present invention relates generally to the field of ball bats used in sports games, and to methods of making the same. In especially preferred forms, the present invention is embodied in ball bats whereby the barrel and handle components of the bat are constructed from two separate structural components and united to one another in such a way to promote both ease of manufacture and improved performance.

BACKGROUND OF THE INVENTION

The design and construction of non-wood bats has predominately been focussed on aluminum alloys and, to a lesser extent, composite materials such as graphite and glass fibers in an epoxy resin matrix. Historically, these conventional bats have been formed of a one-piece construction wherein the handle and the barrel are formed as a unitary (one-piece) structure, with the handle knob and barrel end cap being attached as separate structural components.

Performance of bats is primarily measured in terms of the speed at which the ball rebounds from the barrel. Over the years, bat manufacturers have made design changes to increase ball speed thus improving the performance of the bat. The principal way that ball speed has been increased is by thinning the wall in the barrel of the bat to increase the spring or trampoline effect when the ball impacts the barrel. An increase in ball speed could be obtained by modifying the barrel's circumferential flexibility due to the stiff transition between the barrel's tapered proximal end and the relatively thick-walled handle. As a result, design efforts to increase bat performance has focused on thinning the wall of the barrel to produce the desired spring effect noted previously.

The challenge to making one-piece thin wall aluminum bats is to have high performance and good durability. Persistent significant problems of barrel denting have occurred for high performance bats having relatively thin-walled barrels. Bat manufacturers have attempted to solve such problem by careful selection of aluminum alloys, but such attempts have not met with complete success.

Bats constructed of composite materials, such as graphite, fiberglass and/or aramid fiber-reinforced epoxy resins, have not met with much commercial success. In this regard, the designers of composite bats have followed the same design objectives to produce thin walled flexible barrel bats as described above. The impact strength of composite materials is much less than that for aluminum and aluminum alloys and thus it has been difficult to match the barrel flex of aluminum without breakage. As a result, composite material bats have been produced with a stiffer barrel which lacks the performance characteristics of the aluminum bats having flexible thin-walled barrels.

Recently, a two-piece bat construction has been proposed in U.S. Pat. No. 5,593,158 to Filice et al (the entire content of which is incorporated expressly by reference herein). According to this prior proposal, the handle and barrel are separate structural components having conforming taper segments with an elastomeric isolation union disposed therebetween. This elastomeric isolation union provides the only connection between the handle and the barrel and is said to reduce shock transmitted from the handle to the hands of a user when a ball is hit with the bat. The handle member on these types of bats is short in length and increases in diameter to facilitate connection to the larger diameter barrel member. This limited length and increase in diameter of the handle section minimizes the flexural response of the handle.

SUMMARY OF THE INVENTION

Broadly, the present invention is embodied in ball bats and methods of making the same whereby the handle and barrel are separate structural components with the handle member being of sufficient length to extend through the hollow barrel whereby the handle member is allowed to flex substantially along its entire length to produce a flexural response that will influence the speed of the ball off the barrel of the bat. As such, the handle member may be connected to the barrel member at its proximal and terminal ends. The connection between the handle member and the distal end of the barrel member is most preferably accomplished by means of connecting the terminal end of the handle member to a barrel end plug serving as a distal connector which is connected to, and closes the distal end of, the barrel member.

The barrel end plug is also most preferably formed of a rigid material of sufficient hardness to prevent substantially the terminal end of the handle member from moving. On the other hand, the connection between the handle member at the proximal end of the barrel member is via an elastomeric connector of sufficient flexibility to allow the handle member to flex substantially across its entire length. Moreover, this elastomeric connection at the proximal end of the barrel member is the only means by which structural connection is established between the barrel member and the handle member proximally of the barrel end plug. Thus, in accordance with the present invention the connection between the proximal end of the barrel member and the handle member consists solely of the elastomeric connector.

In such a manner therefore, the rigid (immovable) connection of the handle member's distal end to the distal end of the barrel member and the elastomeric (flexible) connection between the handle member and the proximal end of the barrel thereby allows the handle member to flex substantially across its entire length during ball impact. Stated another way, by means of the present invention, substantial flexure of the handle member occurs between its proximal (knob) end (i.e., the end held by the batsman) and its distal end (i.e., the end which is rigidly connected to the barrel end plug) so as to increase the speed of the ball off the barrel member of the bat when struck thereby increasing the batted distance the ball travels.

Unlike the limited length and increasing diameter taper associated with conventional handle members of two-piece bats, the handle member of the present invention extends along substantially the entire length of the bat and may be provided with a substantially constant diameter along substantially its entire length, a substantially constant tapered diameter along substantially it's entire length, or varying diameters along substantially it's entire length. As such, the handle member may be made more flexible to produce a flexural response along substantially the entire length of the bat thereby influencing the speed of the ball off the barrel of the bat. In addition, the handle member can be "engineered" for different flexural responses to allow the bat to be tailored to individual hitting styles. This method of using the flexural response of the handle member along substantially the entire length of the bat to influence ball speed off the barrel enables the barrel wall to be thickened (as compared to conventional bat barrels) so as to increase barrel strength to resist denting in aluminum alloys and breakage in composites, without sacrificing bat performance.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE PREFERRED EMBODIMENTS

Figure 1:
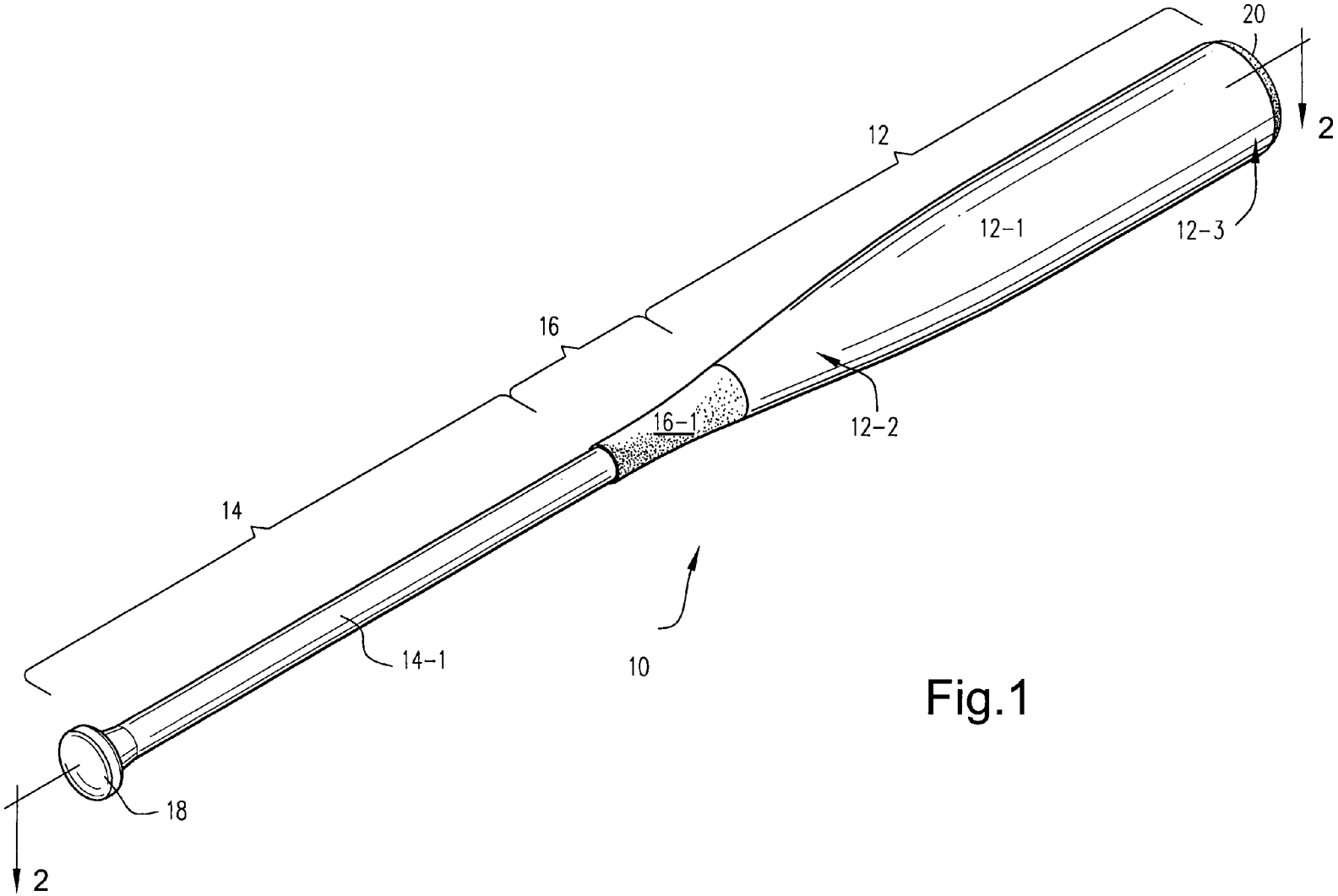
FIG. 1 is a perspective view of one preferred ball bat embodiment in accordance with the present invention.
Figure 2:
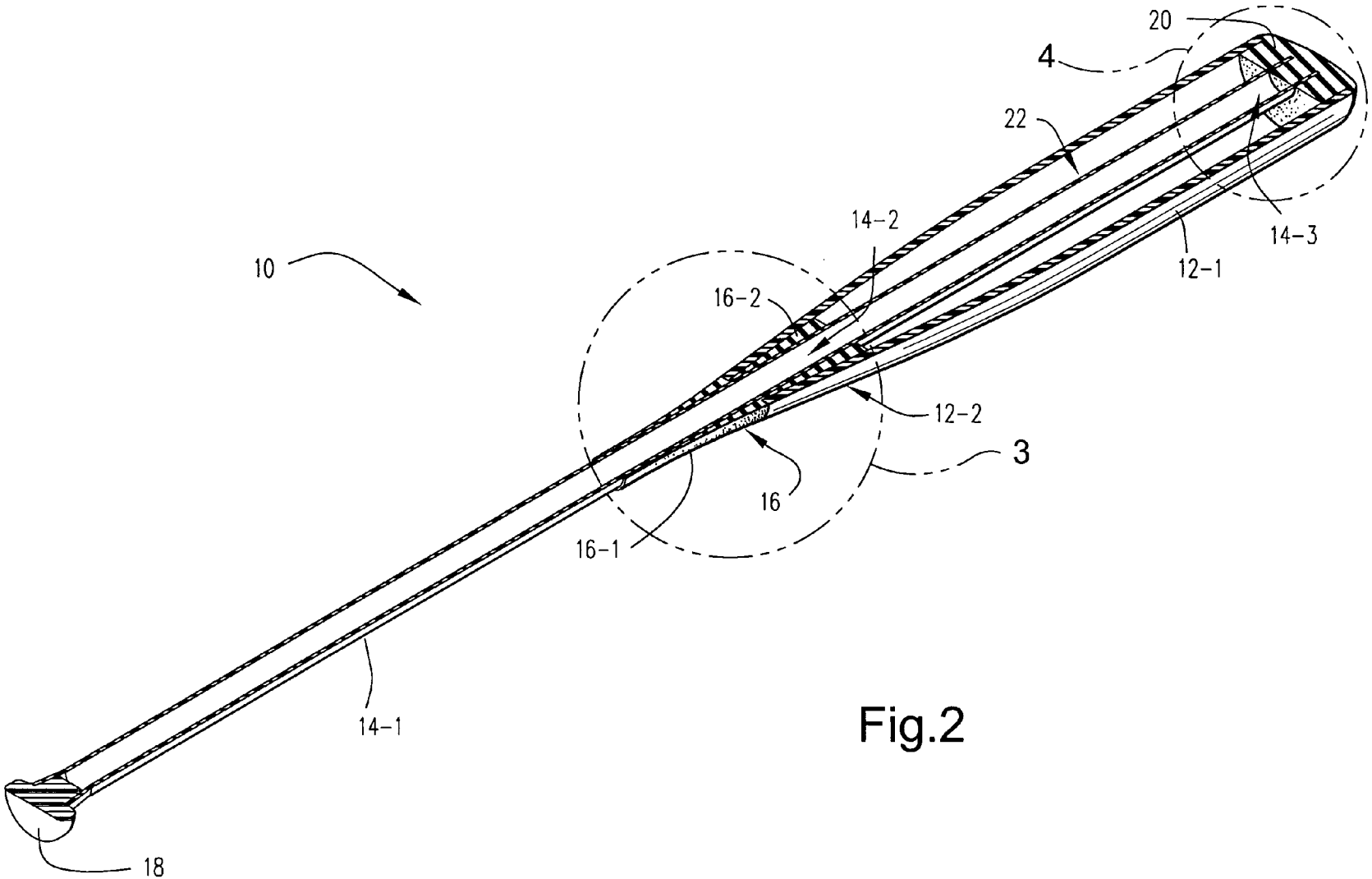
FIG. 2 is a perspective cross-sectional view of the ball bat depicted in FIG. 1 as taken along line 1—1 therein.

An exemplary embodiment of a ball bat 10 in accordance with the present invention is depicted in accompanying FIGS. 1 and 2. As shown therein, the bat 10 generally includes a barrel section 12 which includes a cylindrical hollow barrel member 12-1 having a tapered proximal end 12-2 and an open distal end 12-3. A handle section 14 which includes a smaller-diameter tubular handle member 14-1 extends proximally of the barrel section 12. An intermediate region 14-2 (see FIG. 2) of the handle member 14-1 is structurally joined to the proximal end 12-2 of the barrel member 12-1 by means of a proximally located elastomeric connector 16. A proximal region 16-1 of the connector 16 surrounding the intermediate region 14-2 (see FIG. 2) of the handle member 14-1 provides a visibly smooth tapered transition between the larger-diameter barrel member 12-1 and the smaller-diameter handle member 14-1. The visible portion of the handle member 14-1 which proximally extends from the connector 16 thus establishes the handle region 14 which is adapted to be gripped by a batter during use. As is conventional, a knob 18 is fixed to the proximal end of the handle section 14 to assist holding the bat during use. A barrel end plug 20 is fixed to and closes the open distal end 12-3 of the barrel member 12-1.

As is perhaps shown best in accompanying FIG. 2, the handle member 14-1 is comprised of a one-piece (unitary) tubular structural component having a diameter that is less than that of the barrel member 12-1. Important to the present invention, the handle member 14-1 includes a distally extending internal region 14-3 located physically within the hollow of the barrel member 12-1 and establishing an internal annular space 22 therewithin. Thus, the one-piece handle member 14-1 is coaxially positioned with respect to the barrel member 12-1 and has a length sufficient to establish the proximally extending handle region 14 and the distally extending internal region 14-3.

Figure 3:
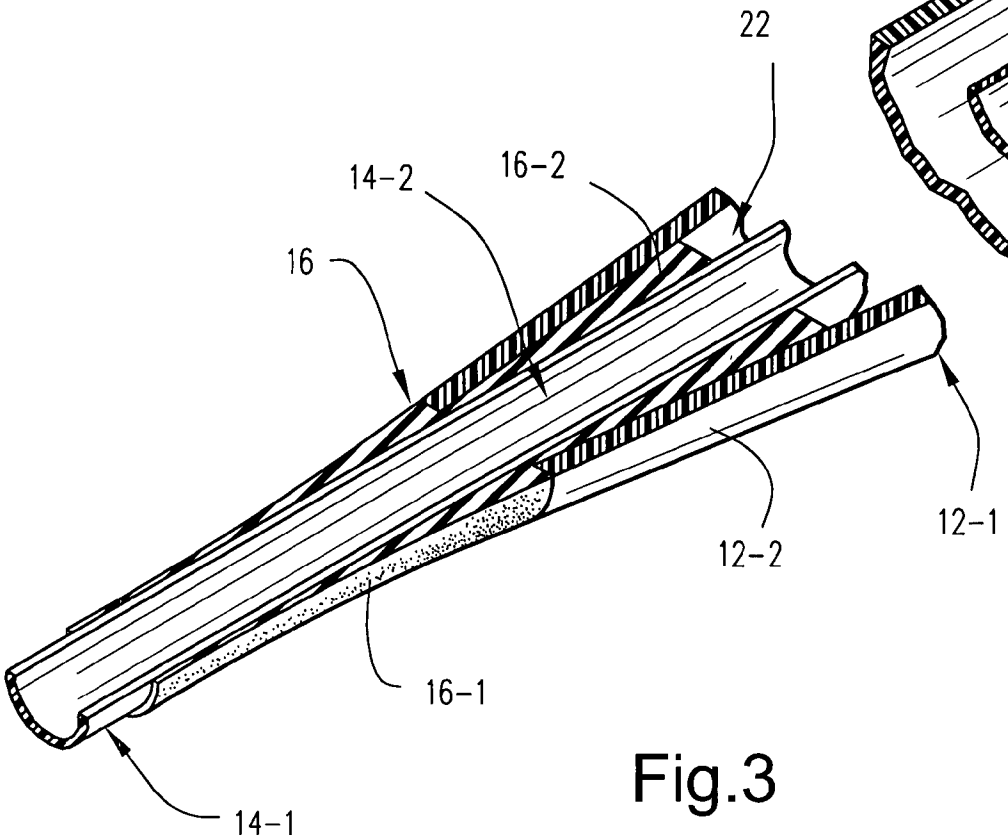
FIG. 3 is an enlarged cross-sectional view of an intermediate region of the ball bat in accordance with the present invention showing a connection between an intermediate region of the handle member and a proximal end of the barrel member.

As noted briefly above, the intermediate region 14-2 is joined physically to the proximal end 12-2 of the barrel member 12-1 solely by means of the elastomeric connector 16. As shown in the enlarged view of FIG. 3, the connector 16 thus includes a distal portion 16-2 which occupies a portion of the annular space 22 established between the intermediate region 14-2 of the handle member 14-1 and the tapered distal end 12-2 of the barrel member 12-1. The proximal portion 16-1 of the connector provides a visibly smooth generally conically-shaped transition between the taper of the distal end 12-2 of the barrel member 12-1 and the smaller-diameter handle region 14 extending proximally thereof.

Figure 4:
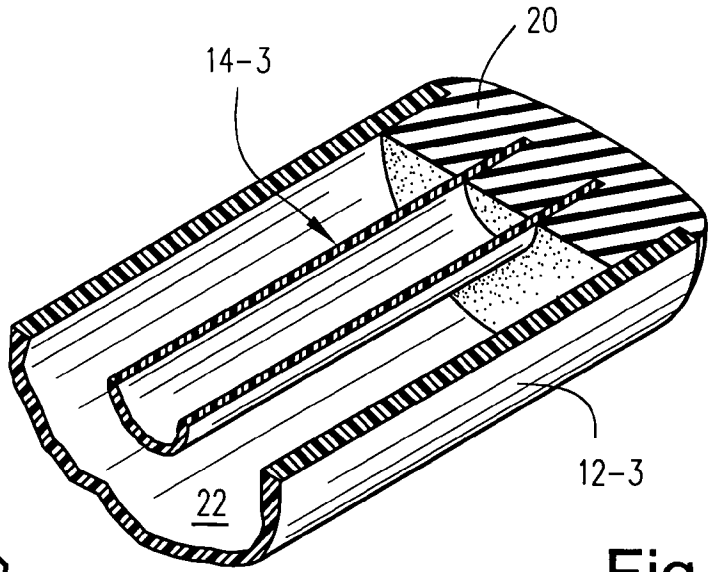
FIG. 4 is an enlarged cross-sectional view of a terminal end region of the ball bat in accordance with the present invention showing a connection between the distal ends of the handle and barrel members.

The terminal distal end of the handle member 14-1, and hence the terminal end of the internal region 14-3, is connected rigidly to a distal connector in the form of a barrel end plug 20 as shown in the enlarged view of FIG. 4. Therefore, the handle member 14 is also connected physically and rigidly to the distal end 12-3 of the barrel member 12 via the barrel end plug 20. As such, the handle member 14 is connected physically to the barrel member 12 at both the proximal and distal ends 12-2 and 12-3, respectively, of the latter. However, as can be appreciated, the connection between the handle member 14 and barrel member 12 at its distal end 12-3 is rigid (immovable), while the connection between the handle member 14 and the barrel member 12 at its proximal end 12-2 is flexible (movable) for the purpose which will be described in greater detail below. Although the handle member 14 and the barrel end plug 20 are depicted as separated structural elements, they may be formed as a unitary (one-piece) structure of a molded plastics or composite material.

The barrel and handle members 12, 14, respectively, may be constructed of a variety of materials conventionally employed in the art for making ball bats. Thus, the barrel member 12 and handle member 14 may be made of the same or different metal or non-metal material. If constructed of a metal, aluminum and aluminum alloys are preferable. If constructed of a non-metal, a fiber-reinforced composite material is most preferred, such as a thermoplastic resin or thermoset epoxy resin reinforced with fibers formed of graphite, glass and/or Kevlar® aramid.

The elastomeric connector 16 and the barrel end plug 20 may be formed of the same or different materials as may be desired by the bat designer to achieve particular bat performance properties, provided that the material forming the connector 16 is of a sufficient low hardness to be elastomeric (flexible) while the material forming the barrel end plug 20 is of a sufficiently high hardness to be substantially rigid. In the embodiment depicted in FIGS. 1–4, however, both the connector 16 and barrel end plug 20 are most preferably constructed of a solid moldable plastics material. Most preferably, each of the connector 16 and barrel end plug 20 is made from a moldable urethane, such as FLEXANE® urethane commercially available from ITW Devcon of Danvers, Mass.

The weight of the connector 16 and barrel end plug 20 can be varied to achieve the desired weight, balance and swing weight of the bat. In addition, although the handle member 14 has been shown and described herein as being of substantially constant cross-sectional diameter, it may be desirable to taper the handle member 14 so that one region of the handle member 14 is of a different diameter as compared to another region thereof. Thus, it may be desirable if the internal region 14-3 of the handle member 14 was tapered, which tapering can occur proximally or distally relative to the intermediate region 14-2. Moreover, the handle member 14 may have multiple different diameters along its axial length. Suffice it to say that the bat designer may envision various physical embodiments of the structures described herein so as to "engineer" a particular bat performance.

Figure 5:
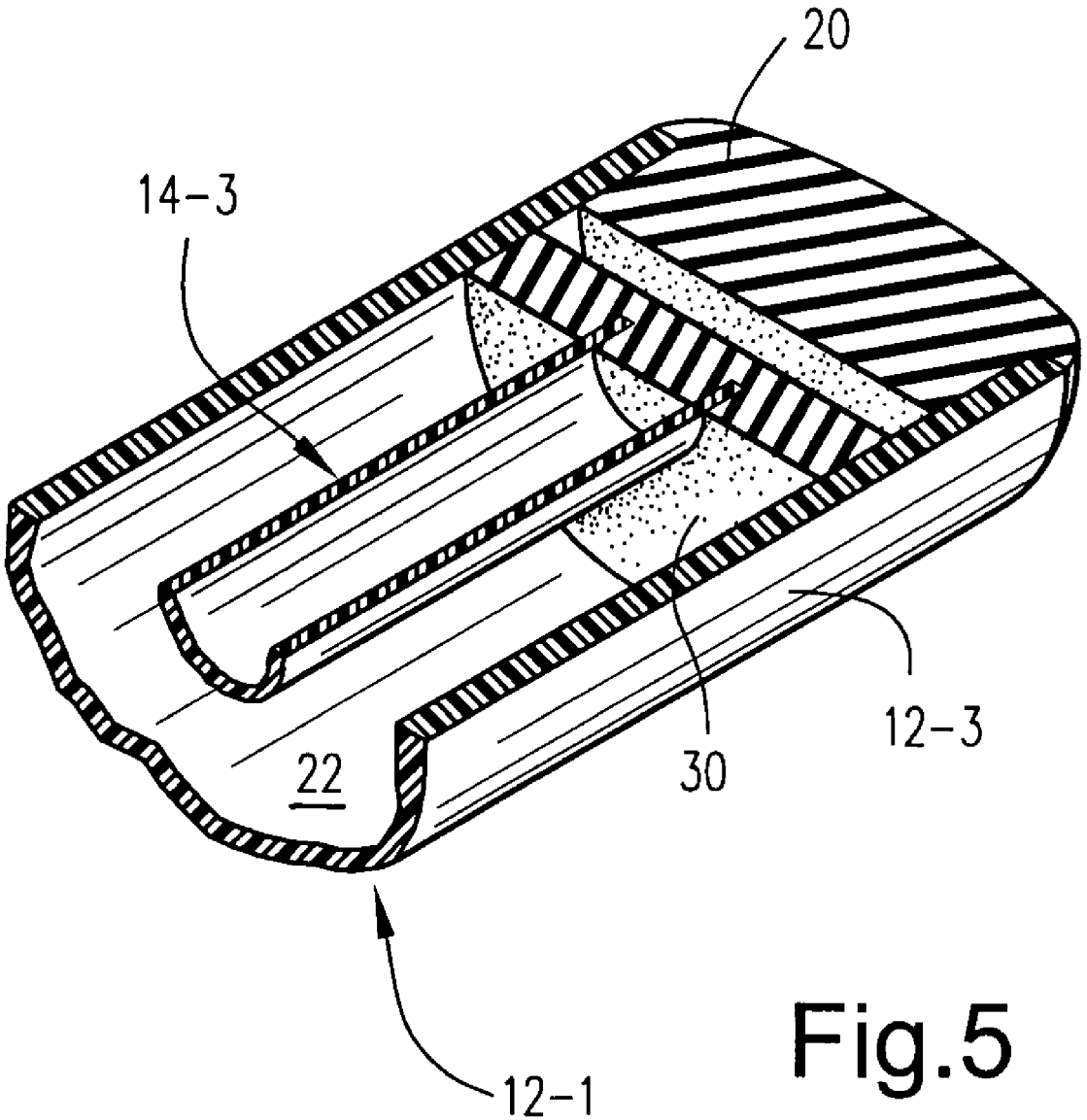
FIG. 5 is an enlarged cross-sectional view of a terminal end region of the ball bat in accordance with the present invention showing an alternative connection between the distal end of the handle member and the distal end of the barrel member thereof.
Figure 6:
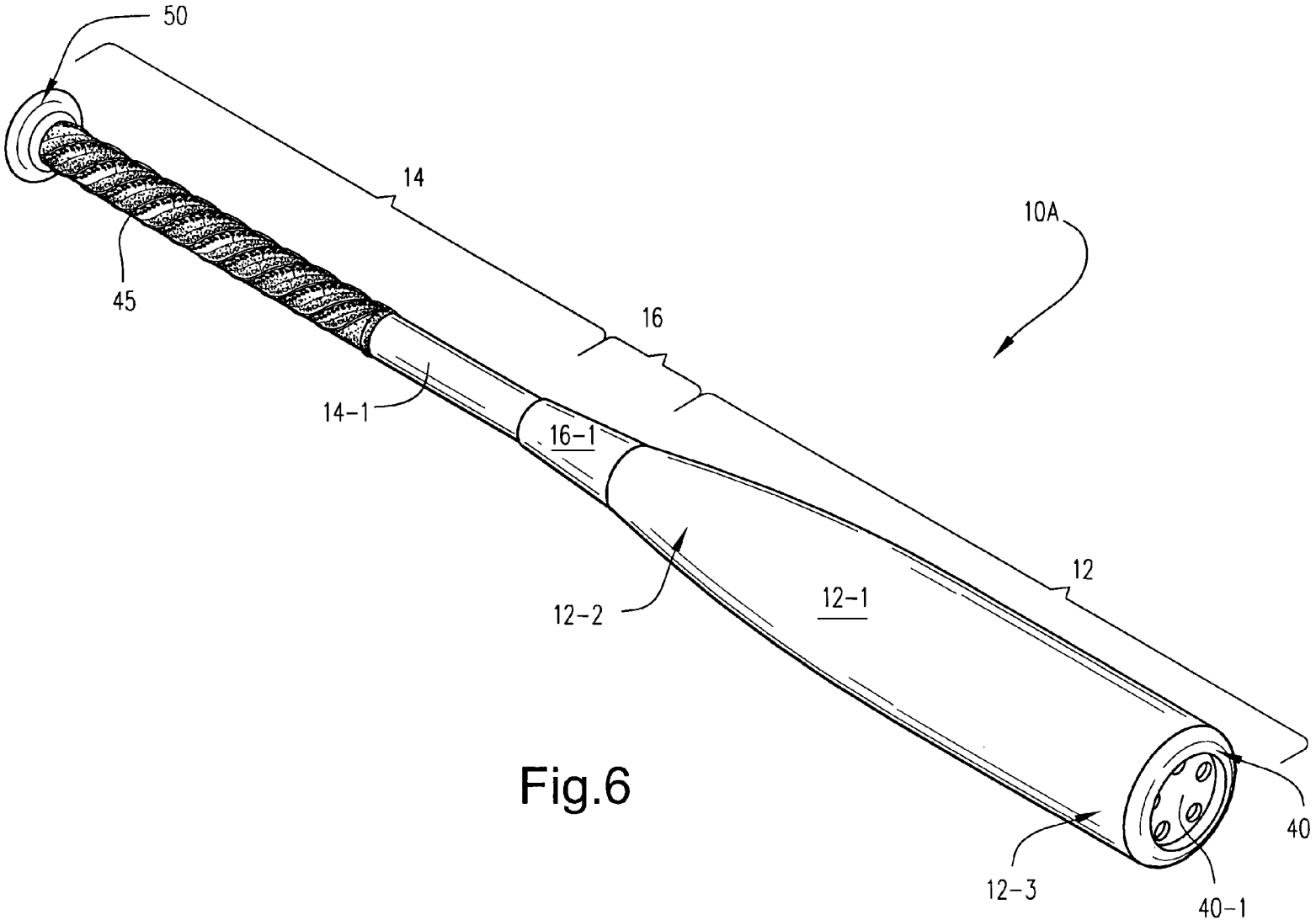
FIG. 6 is a perspective view of another preferred ball bat embodiment in accordance with the present invention.
Figure 7:
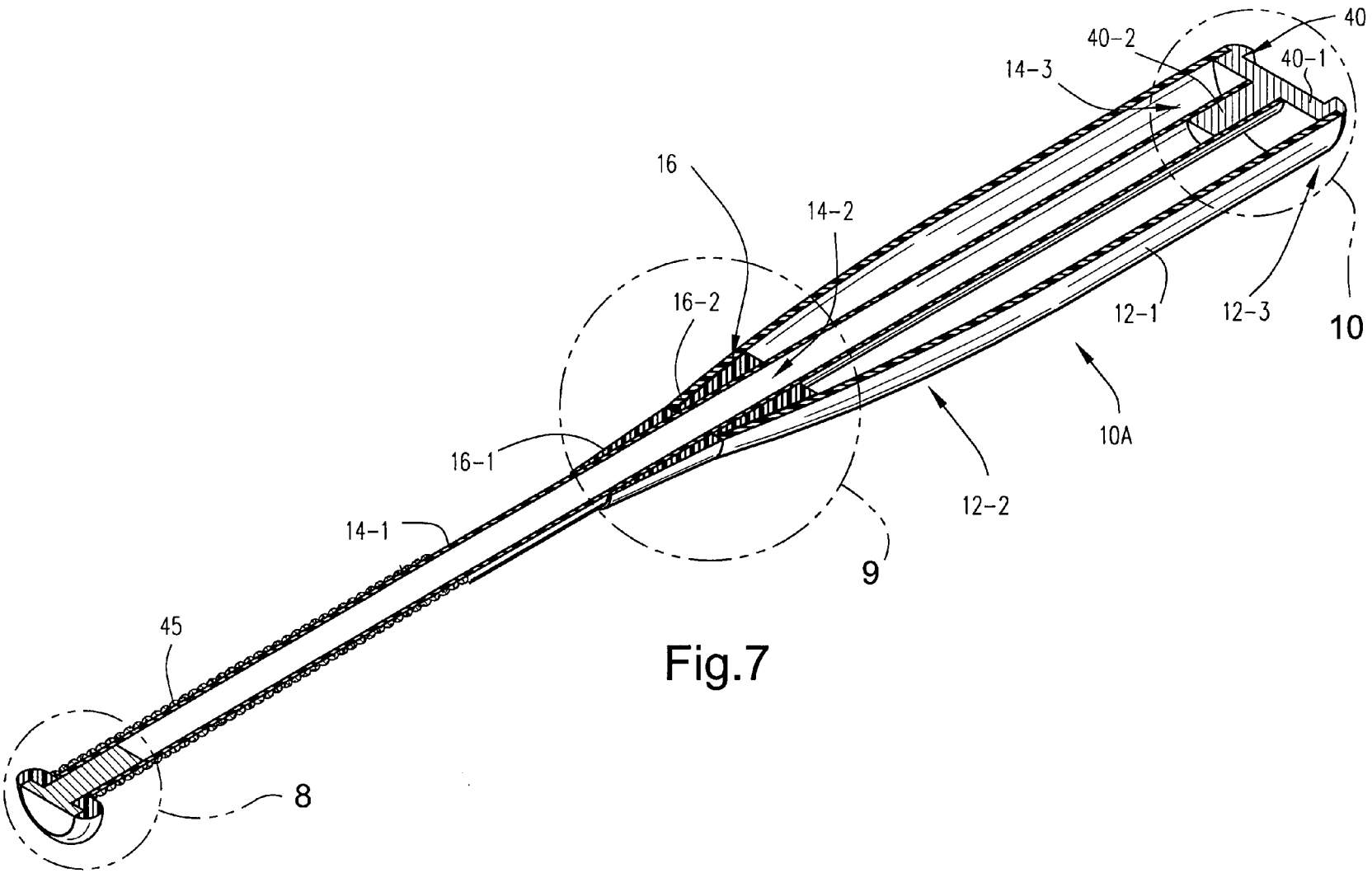
FIG. 7 is a perspective cross-sectional longitudinal view of the ball bat depicted in FIG. 6.
Figures 8, 9, 10:
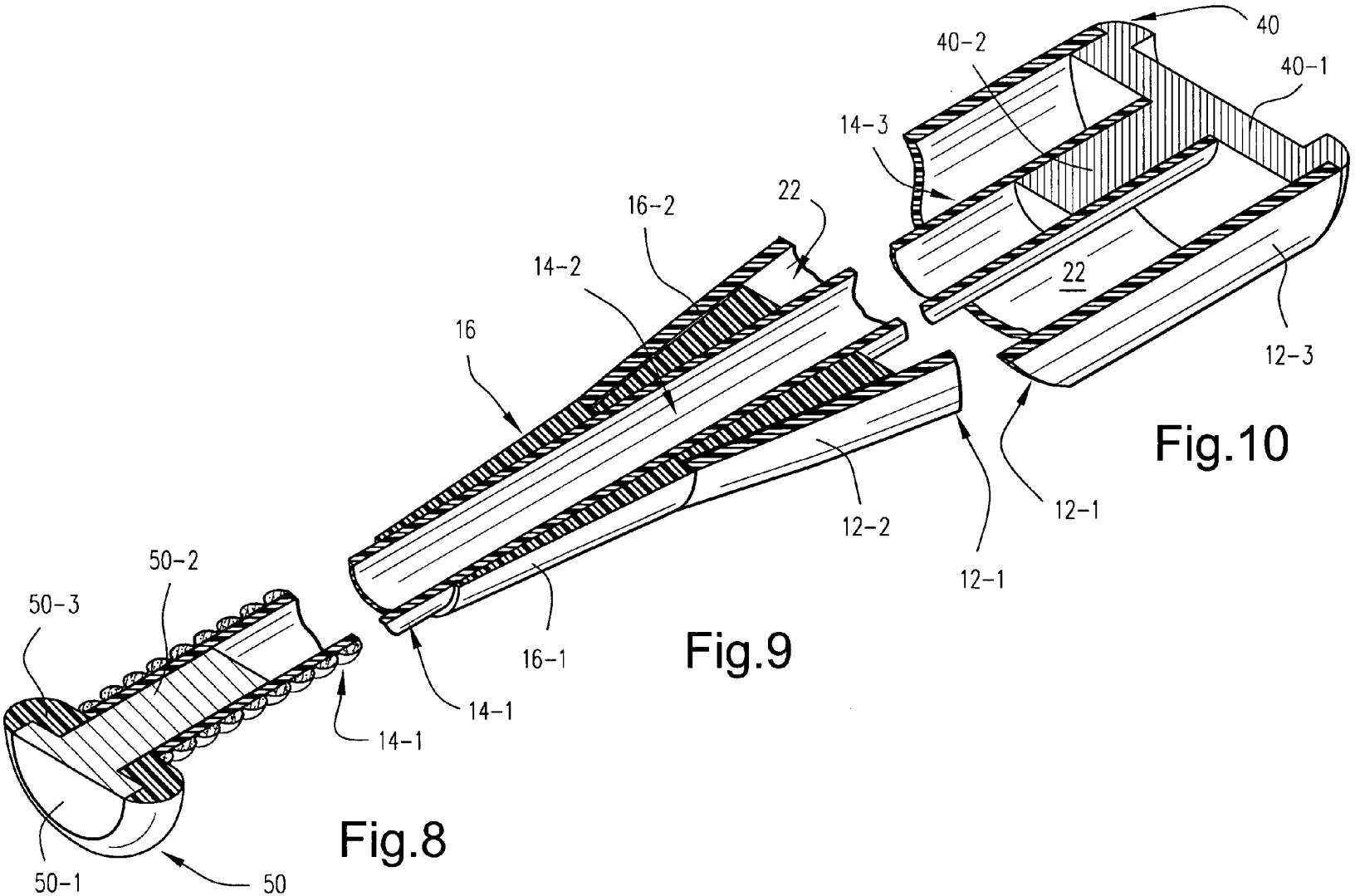
FIGS. 8–10 are enlarged cross-sectional views of the ball bat depicted in FIG. 7 at proximal, intermediate and distal locations thereof, respectively.

Accompanying FIG. 5 depicts another possible distal connector that may be employed according to the present invention so as to establish a rigid connection between the terminal end of the internal region 14-3 of handle member 14 and the distal end 12-3 of the barrel member 12-1. In this regard, it will be observed that the interior of the barrel member 12-1 includes a rigid connection disc 30 proximally of the barrel end plug 20. The terminal end of the internal region 14-3 is thus connected to the connection disc 30 which therefore serves as a distal connector to join rigidly such terminal end of the internal region 14-3 to the distal end of the barrel member 12-1.

The connection disc may be positioned within the barrel at a location from about mid-way of the barrel member's length to its terminal end thereof. Although the connection disc 30 is depicted in FIG. 5 as being positioned close to, but proximally spaced from, the barrel end plug 20, the disc 30 and end plug 20 may be abutted physically against one another if deemed desirable and/or necessary for a particular bat design. As with the barrel end plug 20, the connection disc 30 is formed of a rigid material so that the terminal end of the internal region 14-3 is immovably fixed thereto and hence immovably fixed to the terminal end 12-3 of the barrel member 12-1.

The relative hardness of the connector 16, barrel end plug 20 and, if employed, the connection disc 30 are selected within the parameters noted previously so as to achieve the desired performance characteristics for the bat. In this regard, when using moldable plastics materials (e.g., moldable urethanes), the connector 16, the barrel end plug 20 and, if employed, the connection disc 30 may each be formed of a material having a Shore A hardness value of between about 20 to about 100, preferably between about 80 to about 100, and most preferably about 90. The connector 16 is most preferably formed of a moldable plastics material (e.g., a moldable urethane) having a Shore A hardness value which is the same, or less than, the Shore A hardness value of the moldable plastics material (e.g., a moldable urethane) forming the barrel end plug 20 and/or the connection disc 30. Conversely, of course, the barrel end plug 20 and/or the connection disc 30 will be formed of a material having a Shore A hardness which is the same as or greater than the material of the Shore A hardness from which the connector 16 is formed. In this regard, therefore, the connector 16 will most preferably exhibit a hardness value which is between 0 to 20 percent, and more preferably between 0 to about 10 percent, less than the hardness value of the barrel end plug 20 and/or the connection disc 30. As such, the connector 16 exhibits a substantially elastomeric character while the barrel end plug 20 and/or the connection disc 30 exhibit a substantially rigid character so as to ensure a desired flexural response of the handle member 14 is achieved.

Accompanying FIGS. 6–10 depict another exemplary embodiment of a ball bat 10A in accordance with the present invention. In this regard, the ball bat 10A generally comprises similar structural elements as compared to the embodiment of the ball bat 10 described previously and thus the same reference numerals have been employed so as to identify such similar structural elements and will not be described further. The embodiment of the ball bat 10A does, however, differ from the bat 10 described previously in certain aspects that will be discussed below.

The bat 10A shown in FIGS. 6–10 is most preferably provided with a solid rigid end plug 40 which closes the distal end of the hollow barrel member 12-1. The end plug 40 is preferably formed of metal (e.g., aluminum), but alternatively could be formed of any material that is rigid, for example, a moldable plastics material (e.g., a thermoplastic material such as nylon or a thermoset composite material such as an epoxy/graphite moldable urethane) having the characteristics as described above. As is perhaps shown more clearly in FIGS. 7 and 10, the end plug 40 is a one-piece structure having a disc 40-1 and a post 40-2 coaxially proximally extending from the disc 40-1. The post 40-2 is sized and configured so as to be inserted within the terminal end of the internal region 14-3. A suitable adhesive may be employed so as to immovably join the post 14-2 to the terminal end of the internal handle region 14-3 and the former may be press fit into the latter to establish a friction lock there between. Alternatively, the post 14-2 may be in the form of a hollow cylinder which is sized and configured to accept therein the end of the internal handle region 14-3 in a press fit relationship with or without the presence of an adhesive.

A portion or the entirety of the handle region 14-3 may be spirally wrapped with a grip tape 45, preferably formed of leather material.

The knob 50 included with the bat 10A is most preferably a composite structure having a solid metal core comprised of a circular disc-shaped head 50-1 and a cylindrical shaft 50-2 extending distally therefrom. A knob member 50-3 surrounds the head 50-1 and is most preferably formed of plastics material (e.g., nylon). The particular materials from which the knob core is constructed and/or the dimensions of the head 50-1 and/or the shaft 50-2 will affect the weight of the knob 50 which will, in turn, affect the weight and balance of the bat 10A. Thus, by selectively modifying such parameters, the bat designer may provide the bat 10A with customized weight and balance characteristics for individual batsmen. Most preferably, the knob member 50-3 has a different (preferably lesser) weight as compared to the knob core formed of the head 50-1 and shaft 50-2.

Figure 11:
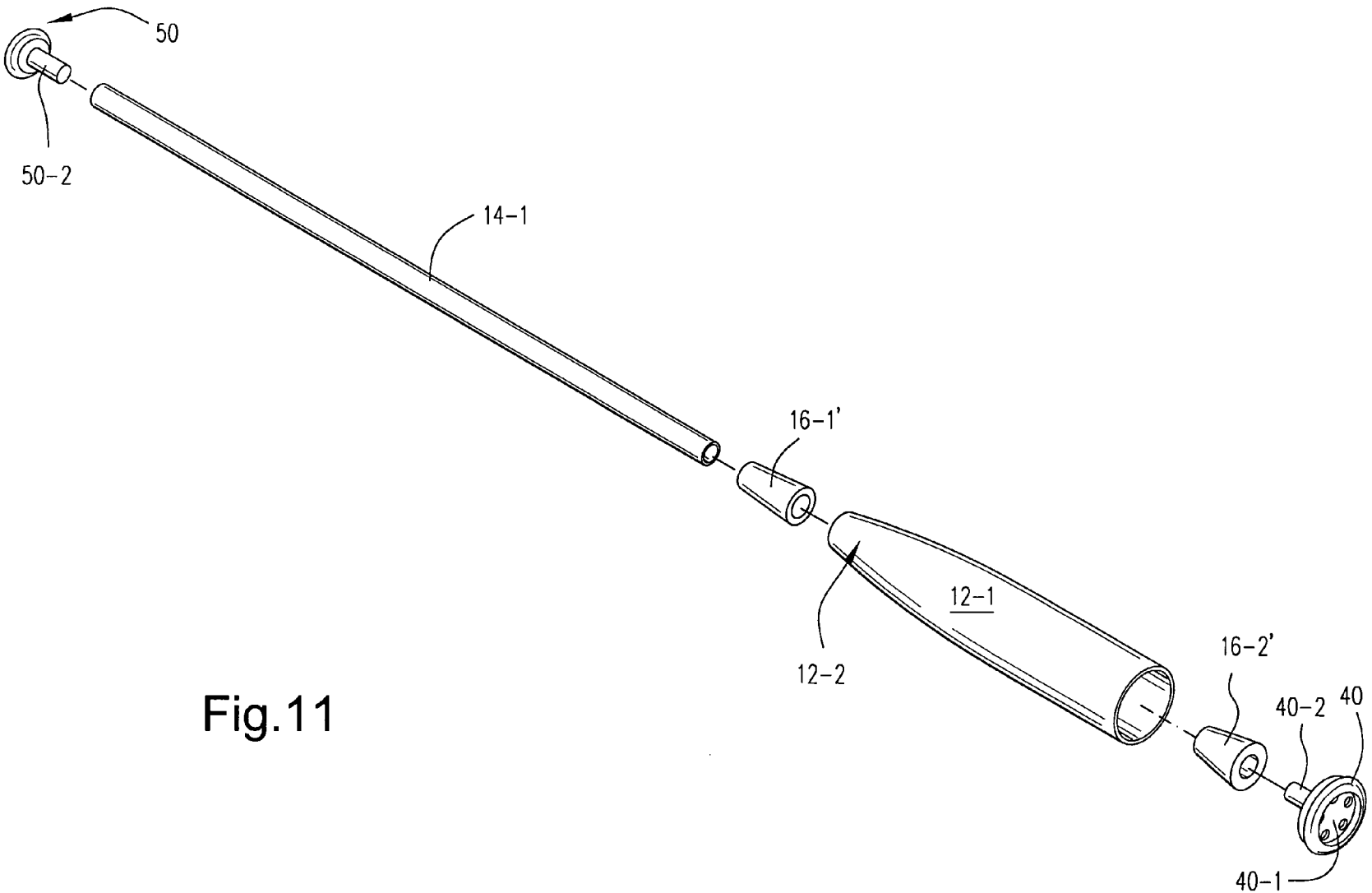
FIG. 11 is an exploded perspective view of another ball bat embodiment in accordance with the present invention showing a possible alternative modification that may be made to the ball bat embodiment generally depicted in FIG. 6.

Accompanying FIG. 11 shows a possible modification of the bats and 10A discussed immediately above. Specifically, it will be observed in FIGS. 3 and 9, for example, that the connector 16 is a one-piece structure comprised of proximal and distal portions 16-1, 16-2, respectively. Such an embodiment for the connector 16 is therefore most preferably formed by means of injection molding of the plastics material (e.g., a urethane) between the preassembled barrel and handle members 12, 14, respectively. However, in accordance with the embodiment depicted in FIG. 11, the proximal and distal portions 16-1' and 16-2' of the connector 16 may be preformed (premolded) as separate structural elements which are thus presized to fit a particular bat's components.

As shown in FIG. 11, the bat may be assembled by sleeving the proximal portion 16-1' over the handle member 14-1 to a location establishing the most proximal extent of the barrel member 12. Thereafter, the barrel member 12 and the distal portion 16-2' may be sleeved over the handle member 14-1 in sequence such that the distal portion 16-2' is positioned within the proximal taper portion 12-2 of the barrel member 12-1. Once the barrel member 12 is positioned, the end plug 40 may be secured to the open distal end of the former such that its post 40-2 is inserted into the distal end of the handle member 14-1. The grip tape 45 (not shown in FIG. 11, but see FIGS. 6 and 7) may then be wrapped spirally around the handle portion 14-3. The various components of the bat described previously may be fixed to one another via suitable adhesive, for example, a urethane or epoxy adhesive which is compatible with the bat's structural components.

As noted previously, the rigid (immovable) connection of the handle member's distal end to the distal end of the barrel member and the elastomeric (flexible) connection between the handle member and the proximal end of the barrel thereby allows the handle member to flex substantially across its entire length during ball impact. Accompanying FIGS. 12A–12C depict in a schematic fashion the manner in which the bats of the present invention function to achieve increased ball speed when batted, and hence an increased batted distance.

Figure 12A:
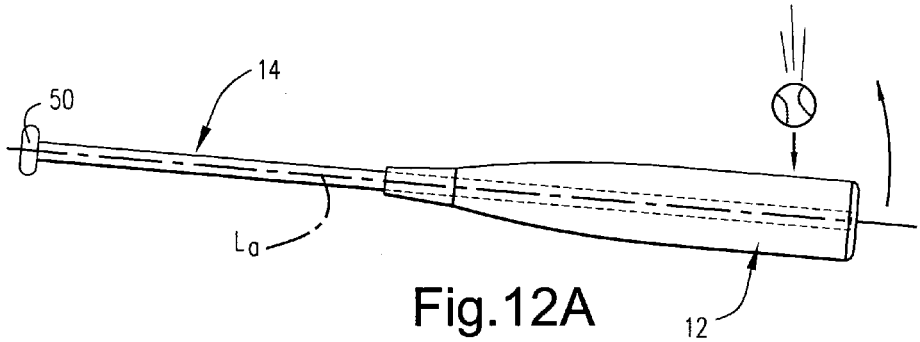
FIGS. 12A–12C depict in schematic fashion a sequence whereby a ball bat in accordance with the present invention is swung by a batsman to strike a pitched ball.
Figure 12B:
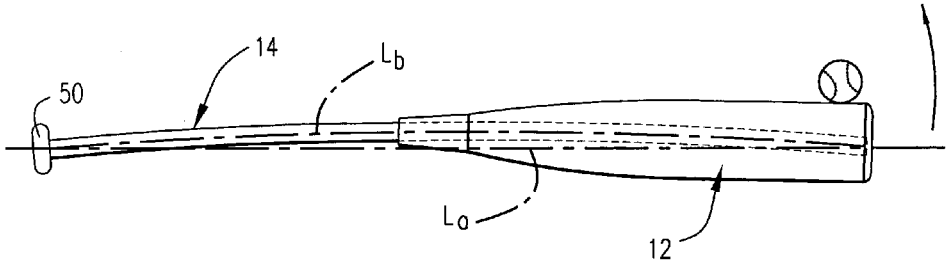
Figure 12C:
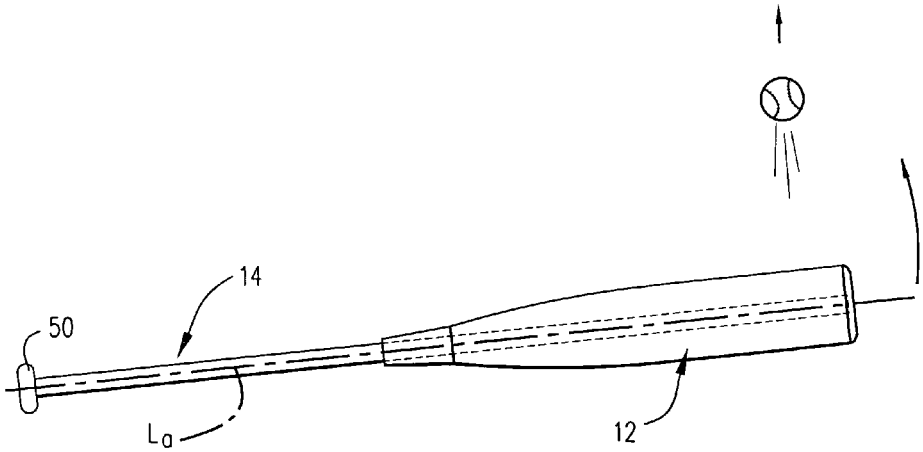

As will be observed, FIGS. 12A–12C depict a brief timewise segment of a batter's swing from a moment just prior to the bat 10 striking a pitched baseball B (FIG. 12A), through a moment when the bat 10 making contact with the pitched ball B (FIG. 12B) and then to a moment of follow-through for the bat 10 whereupon the pitched ball B has been propelled into the playing field. In this regard, it will be observed in FIG. 12A that, as the batter swings the bat 10, both the handle barrel member 12 and handle member 14 are aligned coaxially with the bat's rectilinear longitudinal axis $L_a$. However, upon striking the pitched ball B, the handle member 14 is responsively flexed or bowed along its entire length from the knob 50 to the distal most end thereof as shown in FIG. 12B. Thus, as depicted therein, the longitudinal axis of the handle member $L_b$ is bowed relative to, and hence is no longer coincident with, the bat's longitudinal axis $L_a$. Substantially simultaneously with the ball B being propelled away from the barrel member 12 of the bat after being struck initially, the resulting flexure of the handle member 14 will resiliently return to a state whereby the axis $L_b$ of the handle member 14 and the axis $L_a$ of the bat 10 will again coincide.

The momentary flexure and resilient recovery by the handle member 14 at substantially the instant the ball B is struck by the bat 10 will translate into an increase speed of the ball B off the bat. This increased ball speed will in turn increase the distance that the batted ball will travel as compared to balls being struck with a bat not having the flexural responsiveness of the bats in accordance with the present invention. Thus, the substantially uniform flexure of the handle member which occurs between its proximal (knob) end (i.e., the end held by the batsman) and its distal end (i.e., the end which is rigidly connected to the barrel end plug) improves bat performance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A ball bat comprising:

a hollow barrel member having proximal and distal end portions;

an elongate handle member positioned coaxially within the barrel member, said handle member being of sufficient length so as to establish a handle section which extends proximally from said barrel member, an internal section which extends distally within the hollow of said barrel member such that a distal terminal end of said handle member is located adjacent the distal end portion of the barrel member, and an intermediate section located between said handle and internal sections;

a distal connector providing a rigid connection between the distal end portion of the barrel member and the terminal distal end of the handle member; and a proximal connector providing a flexible connection between the proximal end portion of the barrel member and the intermediate section of the handle member, wherein said handle member exhibits a flexural response substantially along its entire length upon a ball striking the barrel member by means of said flexible connection established by said proximal connector between said proximal end portion of the barrel member and the intermediate section of the handle member, and by means of said rigid connection established by said distal connector between the distal end portion of the barrel member and the terminal distal end of the handle member.

2. The ball bat as in claim 1, wherein the proximal end portion of the barrel member and the intermediate section of the handle member are connected to one another by means which consists solely of the proximal connector.

3. The ball bat as in claim 1, wherein said proximal end of said barrel member is tapered, and wherein said proximal connector includes a proximal taper section which establishes a smooth transition from said tapered proximal end of said barrel member to said intermediate region of said handle member.

4. The ball bat as in claim 1, wherein said distal end of said barrel member is open, and wherein said distal connector includes a barrel end plug which closes said open distal end of said barrel member, and wherein a terminal end of said handle member is connected to said barrel end plug.

5. The ball bat as in claim 1, wherein said distal connector includes an internal connection disc, and wherein a terminal end of said handle member is connected to said connection disc.

6. The ball bat as in claim 1, wherein said handle member is substantially constant lengthwise cross-sectional diameter.

7. The ball bat as in claim 1, wherein said proximal connector consists of an elastomeric material having a Shore A hardness value of between about 20 to about 100.

8. The ball bat as in claim 7, wherein said proximal connector is comprised of a urethane elastomer.

9. A ball bat as in claim 7, wherein said distal connector comprises a barrel end plug formed of a rigid plastics material.

10. The ball bat as in claim 9, wherein said distal connector is comprised of a rigid urethane.

11. The ball bat as in claim 1, wherein said distal connector comprises a barrel end plug formed of metal.

12. A ball bat as in claim 1, wherein a proximal terminal end of said handle member includes a knob.

13. A ball bat as in claim 12, wherein said knob comprises a metal core having a circular disc-shaped head and a cylindrical shaft extending distally therefrom.

14. A ball bat as in claim 13, wherein said knob comprises a knob member which surrounds said disc-shaped head of said core and has a different weight as compared to said core.

15. A ball bat as in claim 1, further comprising a grip tape spirally wrapped around said handle section.

16. A ball bat as in claim 3, wherein said proximal taper section is formed as a one piece structure with said proximal connector.

17. A ball bat as in claim 3, wherein said proximal taper section and said proximal connector are separate structural components.

18. The ball bat as in claim 1, wherein said handle member has varying lengthwise cross-sectional diameters.

19. The ball bat as in claim 18, wherein said handle member is tapered along its length.

* * * * *